United States Patent [19]

Dutcher

[11] 4,194,632

[45] Mar. 25, 1980

[54] CANDY AND PILL DISPENSER CARTON

[75] Inventor: Daniel P. Dutcher, Woodbury, Minn.

[73] Assignee: Champion International Corporation, Stamford, Conn.

[21] Appl. No.: 902,802

[22] Filed: May 4, 1978

[51] Int. Cl.[2] ..... B65D 5/72; B65D 17/24

[52] U.S. Cl. ..... 206/626; 206/629; 229/17 R; 229/38

[58] Field of Search ..... 206/626, 621, 629; 229/17 B, 17 R, 38, 39 R, 44 R

[56] References Cited

U.S. PATENT DOCUMENTS

| | | | |
|---|---|---|---|
| 340,904 | 4/1886 | Auchterlonie | 229/17 B |
| 2,789,746 | 4/1957 | Hovland | 206/621 |
| 3,059,827 | 10/1962 | Pellaton et al. | 229/17 R |
| 3,153,504 | 10/1964 | Mischel et al. | 229/17 R |
| 3,423,005 | 1/1969 | Leibson et al. | 229/44 R |
| 3,595,466 | 7/1971 | Rosenburg, Jr. | 206/626 |

*Primary Examiner*—Stephen P. Garbe

*Attorney, Agent, or Firm*—Evelyn M. Sommer

[57] ABSTRACT

A dispensing carton and blank for forming the same is provided with a top closure panel hingedly connected to the front wall of the carton. A bottom panel hingedly connected to the back wall of the carton underlies the top closure panel and is provided with a dispensing opening therethrough. The top closure panel connected to the front wall has a tab tacked into sealing engagement with the edge of the bottom panel surrounding the dispensing opening. The top closure panel is opened by rotating the panel which breaks the seal between the tab and bottom panel to enable the contents of the carton to be dispensed through the opening. The top closure panel has lateral panels extending into the interior of the carton which abut the back wall of the carton when the top closure panel is opened to form a bin into which the contents of the carton is dispensed from the opening. The dispensing opening is resealed by returning the top closure panel back into abutting engagement with the bottom panel.

3 Claims, 13 Drawing Figures

Fig. 1
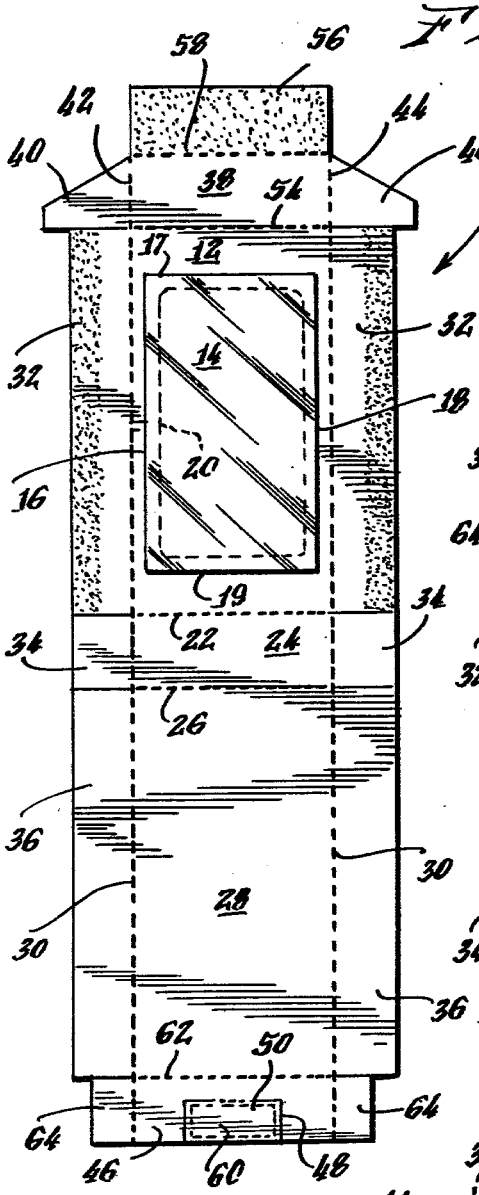
Fig. 2.
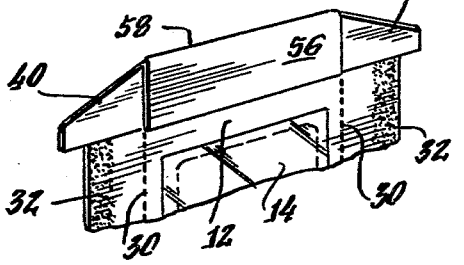
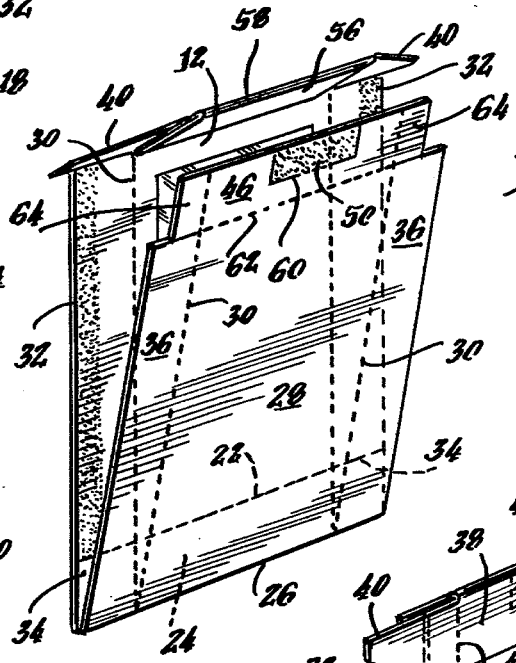
Fig. 3
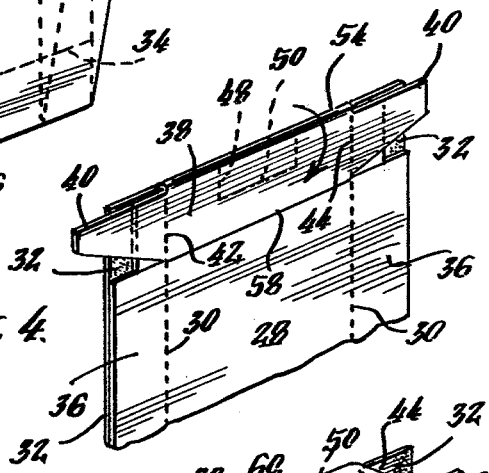
Fig. 4.
Fig. 5.
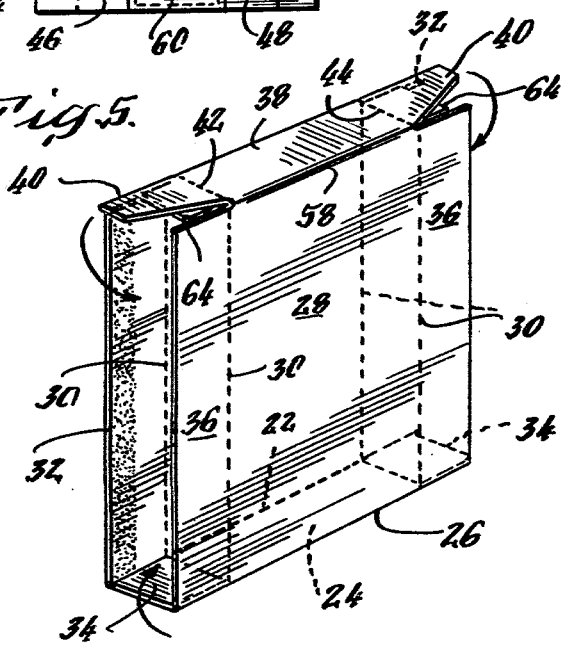
Fig. 6.
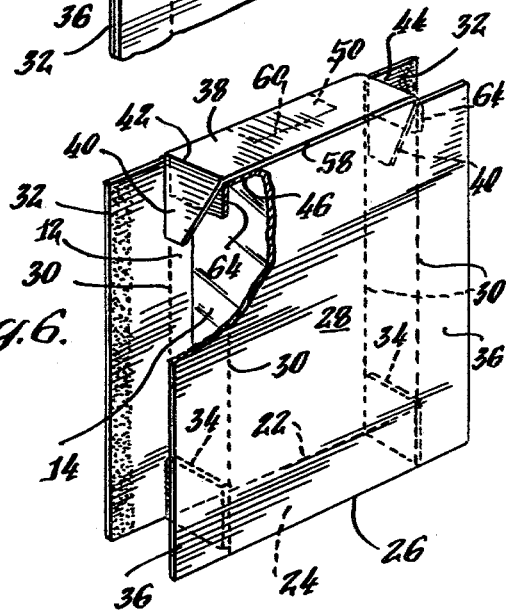

Fig. 7.
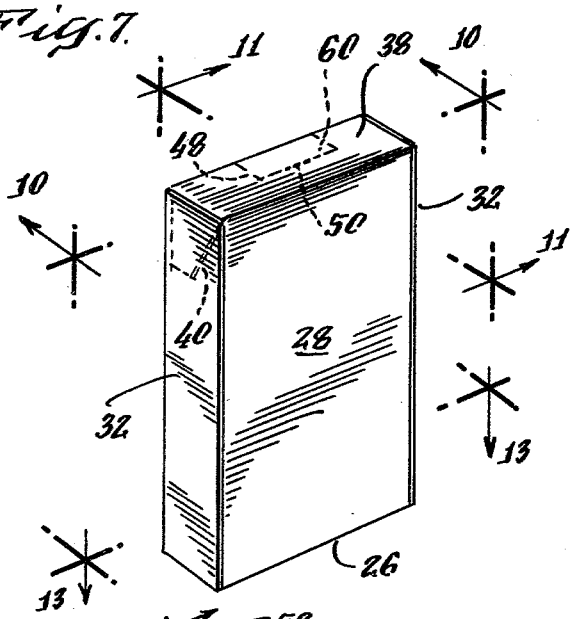
Fig. 8.
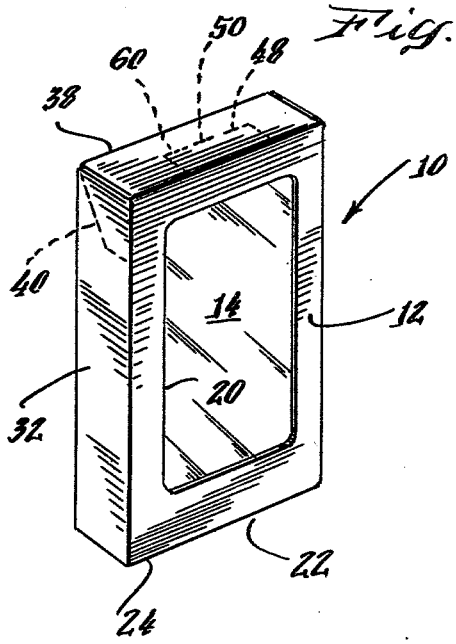
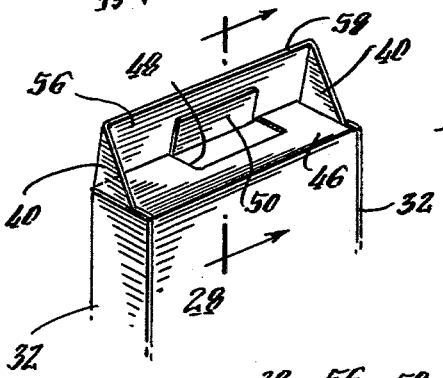
Fig. 9.
Fig. 10.
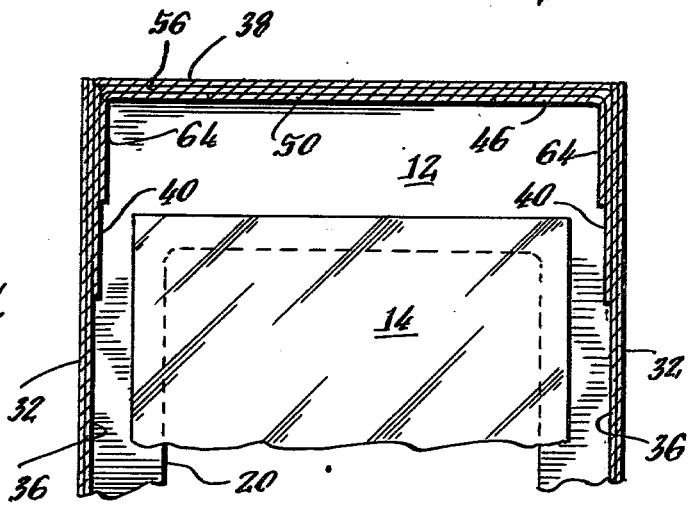
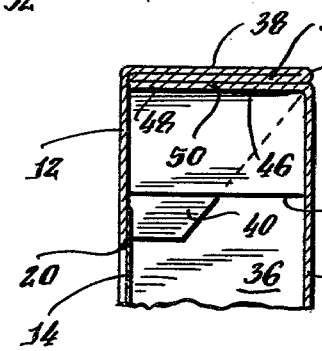
Fig. 11.
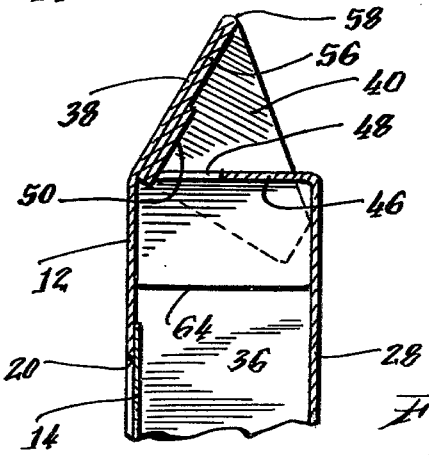
Fig. 12.
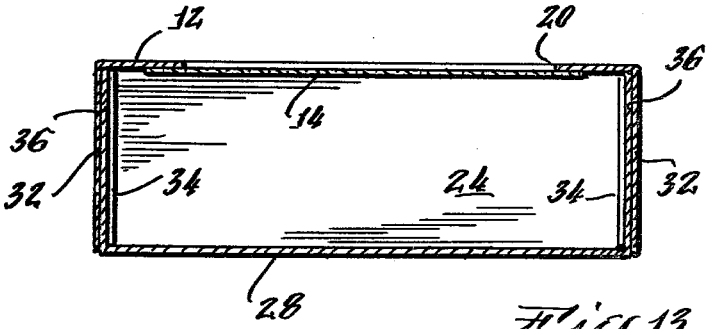
Fig. 13.

CANDY AND PILL DISPENSER CARTON

BACKGROUND AND SUMMARY OF THE INVENTION

This invention relates to a carton construction, and more particularly, a carton construction which can be used to dispense candy and/or pills through an opening provided in the top wall closure of the carton.

Carton constructions have been proposed heretofore for dispensing small articles such as candy and pills one at a time through and opening formed in the carton. Usually, a lateral slide closure is employed to reseal the dispensing opening in order to prevent inadvertent spillage of the carton contents, which results in a complex blank used to manufacture the carton.

This invention provides a carton construction including a small dispensing opening in the top wall closure of the carton through which articles can be removed one at a time from the interior of the carton by rotating a top closure panel which breaks a carton seal. Once the seal provided on the top closure panel of the carton is broken, the dispensing opening is resealed by simply reseating the top closure panel over the dispensing opening. Such a carton construction lends itself to mass production in that it is formed from a simple, substantially rectangular, unitary, paperboard blank.

The blank is provided with a front panel hingedly connected to a bottom panel, which in turn, is hingedly connected to a back panel. Each of the panels is formed of a substantially rectangular configuration. Side panels are connected along vertical score lines to the opposite edges of the front, bottom and back panels. An inverted substantially U-shaped panel is hingedly connected by a score line to the bottom or free edge of the back panel. The center or bight portion of the inverted U-shaped extension panel forms a dispensing opening for articles disposed within the carton when the carton blank is folded into a rectangular parallelopiped configuration. A tab is connected by a partially cut and perforated score line to the bight portion of the inverted U-shaped extension panel and fills the dispensing opening.

Connected to the top or free edge of the front panel is a substantially rectangular extension panel which is adapted to be folded back upon itself and forms a portion of the top closure for the carton. Long side flaps foldable about vertical score lines are connected to the extension panel.

When the blank is folded into a substantially rectangular parallelopiped carton configuration, the tab is adhesively connected to the extension panel and the side flaps are inserted within the interior of the folded carton. The side panels connected to the front and back panels are overlapped and adhesively joined. By rotating the rectangular extension panel, which has been folded back upon itself to form the top closure, the tab adhesively connected to it will separate along its cut and perforated line exposing the dispensing opening, enabling articles within the carton to be dispensed one at a time therethrough. THe side flaps will abut the back wall of the carton, limiting movement of the opened top closure and form with the top closure a bin for receiving the dispensed articles. The dispensing opening is simply resealed by reseating the top closure panel over the inverted U-shaped extension panel (forming the bottom seat of the closure). The side flaps serve to guide and hold the top closure panel in seated engagement on the U-shaped extension panel.

BRIEF DESCRIPTION OF THE DRAWINGS

Further objects and advantages of the invention will become apparent from the following description and claims, and from the accompanying drawings, wherein:

FIG. 1 is a plan view of a blank for forming the carton construction of the present invention;

FIGS. 2 through 6, inclusive, are perspective views illustrating the folding of the blank of FIG. 1 into a carton construction;

FIG. 7 is a rear perspective view of the carton construction of the present invention;

FIG. 8 is a front perspective view of the carton construction of FIG. 7;

FIG. 9 is a perspective view of an opened top closure of the carton of FIGS. 7 and 8;

FIG. 10 is a cross-sectional view taken substantially along the plane indicated by line 10—10 of FIG. 7;

FIG. 11 is a cross-sectional view taken substantially along the plane indicated by line 11—11 of FIG. 7;

FIG. 12 is a cross-sectional view taken substantially along the plane indicated by line 12—12 of FIG. 9; and FIG. 13 is a cross-sectional view taken substantially along the plane indicated by line 13—13 of FIG. 7.

DETAILED DESCRIPTION OF THE PREFERRED EMBODIMENT

Referring now to the drawing in detail, wherein like numerals indicate like elements throughout the several views, the dispensing carton 10 of the present invention includes a substantially rectangular front panel 12 provided with a glassine window 14 so that the contents of the carton can be inspected. The glassine window 14 is adhesively connected to the front panel 12 on the interior surface of the panel by connecting it to spaced portions 16, 17, 18 and 19 of the front panel defined by an opening 20.

Connected to the bottom edge of the front panel 12 along a score line 22 is a rectangular bottom panel 24. Connected to the opposite edge of the bottom panel 24 along a score line 26 is a back rectangular panel 28.

Connected by score lines 30 to the opposite side edges of the front, bottom and back panels 12, 24 and 28, respectively, are side panels 32, 34 and 36, respectively. The carton 10 is closed by a top closure flap 38 having a lateral extension panel 40 connected thereto along opposite edges 42 and 44 and disposed within the interior of carton 10. The closure flap 38 is disposed over a panel 46 provided with a central opening 48 which serves as a dispensing opening for articles within the interior of carton 10. By rotating top closure flap 38 relative to panel 46 (FIG. 9), opening 48 will be uncovered so that articles from the interior of carton 10 can be dispensed therethrough. The panels 40 are of a dimension to abut the rear wall 28 of carton 10 (FIG. 12) to form with panel 46 a bin to receive articles dispensed through opening 48.

In order to reseal carton 10 to close opening 48, once the top closure flap 38 has been opened, the top closure flap 38 is reseated on panel 46; each panel 40 being disposed within the interior of the carton between side panel 64 on panel 46 and overlapping side panels 32, 36 to frictionally hold the top closure flap 38 closed.

The carton 10 is formed from a paperboard blank 52 illustrated in FIG. 1. Blank 52 is substantially planar and includes an upper rectangular panel 12 provided with an opening 20 for forming the front of carton 10. The upper rectangular panel 12 includes side panels 32 connected to opposite edges of panel 12 by vertical score lines 30.

Rectangular panel 24, forming the bottom of the carton 10 is hingedly connected to the lower edge of upper rectangular panel 12 by the score line 22. Side panels 34 are connected by vertical score lines 30 to the opposed edges of bottom panel 24.

Connected to the lower edge of bottom panel 24 by score line 26 is a lower rectangular panel 28 which forms the back of carton 10. Rectangular side panels 36 are hingedly connected to the opposite side edges of back panel 28 by vertical score lines 30.

The top closure panel 38, which is rectangular in shape, is connected by a horizontal score line 54 to the top edge of upper rectangular panel 12. An extension panel 56 is connected by a horizontal score line 58 to the top edge of the top closure panel 38. Side panel flaps 40 are connected to the opposite edges 42 and 44 of top closure panel 38 by score lines 42 and 44, respectively.

Opening 48 is formed in a generally inverted U-shaped lower panel 46 connected by a horizontal score line 62 to the bottom edge of the lower rectangular or back panel 28 of blank 52. Inverted U-shaped panel 46 includes a pair of side panels 64 pivotally connected to the opposite side edges of panel 46 by vertical score lines 30. A tab 50 is connected by a horizontal, partially cut and partially perforated line 60 or a nick to the top edge of the bight portion of the inverted U-shaped panel 46 and closes the opening 48.

As shown in FIGS. 2 through 6, inclusive, blank 52 is folded into carton 10 by folding the front and back rectangular panels 14 about score lines 22 and 26, respectively, so that they occupy substantially parallel planes.

The extension panel 56 is folded about score line 58 and adhesively secured to the front of panel 38. The top closure panel 38 is then rotated 90° about horizontal score line 54 and panel 56 adhesively secured to tab 50 on panel 46 (FIGS. 3 and 4). The remainder of panel 46 is varnished to reject any glue.

Side panels 34 are then folded about vertical score lines 30 so as to have their free side edges abut the front and back panels (FIGS. 5 and 6).

Side panels 40 and 64 are then rotated 90° to lie within the interior of carton 10 (FIG. 6). Side panels 32 connected to the front panel 12 are then folded about their respective score lines 30 as are panels 36, and the panels overlapped and adhesively connected. The carton 10 is thus sealed and the articles previously disposed within the carton are displayed through the glassine window 14 disposed over the opening 20.

In order to dispense articles from the interior of carton 10, it is only necessary to rotate top closure panel 38 approximately 90° to break the nick or perforated portion of line 60 connecting tab 50 within opening 48 in panel 46. (FIG. 9). Tab 50, adhesively connected to panel 56 moves with the top closure panel 38. The side flaps 40 along with panel 46 form a bin to catch articles dispensed through opening 48.

In order to reseal the carton 10, top closure panel 38 is returned into seating engagement on panel 46 closing opening 58. Flaps 40 are returned to the interior of the carton and are frictionally held between each pair of overlapped side walls and side panel 64 to maintain the closure 38 in seated engagement of panel 46 over opening 48.

What is claimed is:

1. A dispensing carton comprising:

a front wall, a back wall, and side walls connecting opposite edges of said front and back walls;

a bottom wall between said front and back walls and said side walls; and a top closure including, a substantially U-shaped panel defining a dispensing opening along the bight portion thereof, a top closure panel for sealing said dispensing opening, the top closure panel including a panel hingedly connected to the top of one of said front and back walls adapted to overlie the dispensing opening in said U-shaped panel, said U-shaped panel being connected to the top of the other one of said front and back walls, a pair of side flaps which are hingedly connected to and perpendicular to the opposite side edges of said top closure panel, said pair of side flaps extending into the interior of said carton, with each side flap having an edge of a dimension to abut one of said front and back walls upon rotation of said top closure panel to limit rotational movement of said top closure panel, and a tab adhesively connected to said top closure panel, said tab being connected by a cut and perforated line to the bight portion of said U-shaped panel within and coplanar to said dispensing opening whereby initial rotation of said top closure panel will break the perforated portion to said cut and perforated line to unseal said dispensing opening, with the side flaps forming with said top closure panel a bin to catch articles dispensed through said dispensing opening, and whereby, upon rotation of said top closure panel to the closed position, said tab is inserted within the interior of said carton through said dispensing opening in order to lock said top closure panel in sealing engagement with the U-shaped panel.

2. A dispensing carton according to claim 1 wherein said top closure panel includes:

a first rectangular panel, and a second rectangular panel foldable 180° with respect to said first rectangular panel and adhesively secured thereto, and said tab being adhesively secured to said second rectangular panel.

3. A dispensing carton according to claim 1 wherein said front panel includes an opening therein covered by a transparent sheet of material.

* * * * *